United States Patent [19]

Schmidt et al.

[11] 4,149,518

[45] Apr. 17, 1979

[54] BAKING OVEN

[75] Inventors: Ulrich Schmidt, Nüremberg; Fritz Reiss, Schwabach; Karl-Heinz Fingerholz, Nüremberg, all of Fed. Rep. of Germany

[73] Assignee: Licentia Patent-Verwaltungs-G.m.b.H., Frankfurt am Main, Fed. Rep. of Germany

[21] Appl. No.: 777,697

[22] Filed: Mar. 15, 1977

[30] Foreign Application Priority Data

Mar. 16, 1976 [DE] Fed. Rep. of Germany ..... 2610937
Mar. 16, 1977 [DE] Fed. Rep. of Germany ... 7608003[U]

[51] Int. Cl.[2] ..... F24C 15/02
[52] U.S. Cl. ..... 126/190; 126/41 D; 126/197; 49/149; 312/311; 126/340
[58] Field of Search ..... 312/138 R, 311, 333; 49/149; 126/190, 197, 198, 19 M, 41, 273 R, 340

[56] References Cited

U.S. PATENT DOCUMENTS

| | | | |
|---|---|---|---|
| 2,110,176 | 3/1938 | Rogers | 126/190 |
| 2,617,404 | 11/1952 | Prather | 126/39 |
| 2,649,085 | 8/1953 | Hurt | 126/41 D |
| 2,815,018 | 12/1957 | Collins | 126/190 |
| 3,290,106 | 12/1966 | Wilson et al. | 312/311 |
| 3,498,285 | 3/1970 | McArthur, Jr. et al. | 126/197 |

*Primary Examiner*—John J. Camby
*Assistant Examiner*—Larry I. Schwartz
*Attorney, Agent, or Firm*—Spencer & Kaye

[57] ABSTRACT

A baking oven has a flame tube defining a baking chamber and a charging opening oriented in a vertical plane; a door for opening and closing the charging opening; a rail structure secured to the door and extending into the oven externally of the flame tube for providing a sliding support for the door for sliding movement in a horizontal direction towards and away from the charging opening. The door is horizontally divided into a lower door portion and an upper door portion. The upper portion is pivotally attached to the lower door portion to provide for a swinging motion of the upper door portion from an upright orientation in an arcuate vertical direction away from the charging opening.

5 Claims, 3 Drawing Figures

BAKING OVEN

BACKGROUND OF THE INVENTION

This invention relates to a baking oven having a flame tube which defines an inner chamber and which has a charging opening disposed in a vertical plane. The oven further has a door for opening and closing the charging opening. To the door there are attached rails which are guided laterally externally of the flame tube in such a manner that the door is displaceable in a horizontal plane with respect to the charging opening, together with a support arrangement attached to the inner side of the door and serving for supporting the food product to be baked.

A baking oven of the above-outlined type is disclosed, for example, in U.S. Pat. No. 2,617,404. The door for closing the charging opening of the flame tube is arranged perpendicularly to the rails and is firmly affixed thereto. By virtue of the fact that in this known oven structure the door is disposed in a rigid, vertical orientation even after opening, a basting or turning of the food product is difficult and inconvenient, particularly in elevated (eye level), built-in kitchen ovens. This inconvenience and difficulty is caused by the fact that the vertically oriented, rigid open oven door is in the way when the above-noted operations are to be performed.

SUMMARY OF THE INVENTION

It is an object of the invention to provide an improved baking oven in which the access to the food product is facilitated in the pulled-out state of the food support.

This object and others to become apparent as the specification progresses, are accomplished by the invention, according to which, briefly stated, the oven door is horizontally divided into an upper and a lower door portion; the upper door portion is pivotally attached to the lower door portion, so that the upper door portion can be pivoted in an arcuate, vertically-oriented direction.

As a result of the above-outlined measure, after pivoting the upper door portion downwardly, the food support is freely accessible even from the front which is of particular advantage in case of eye level ovens.

DESCRIPTION OF THE PREFERRED EMBODIMENT

Figure 1:
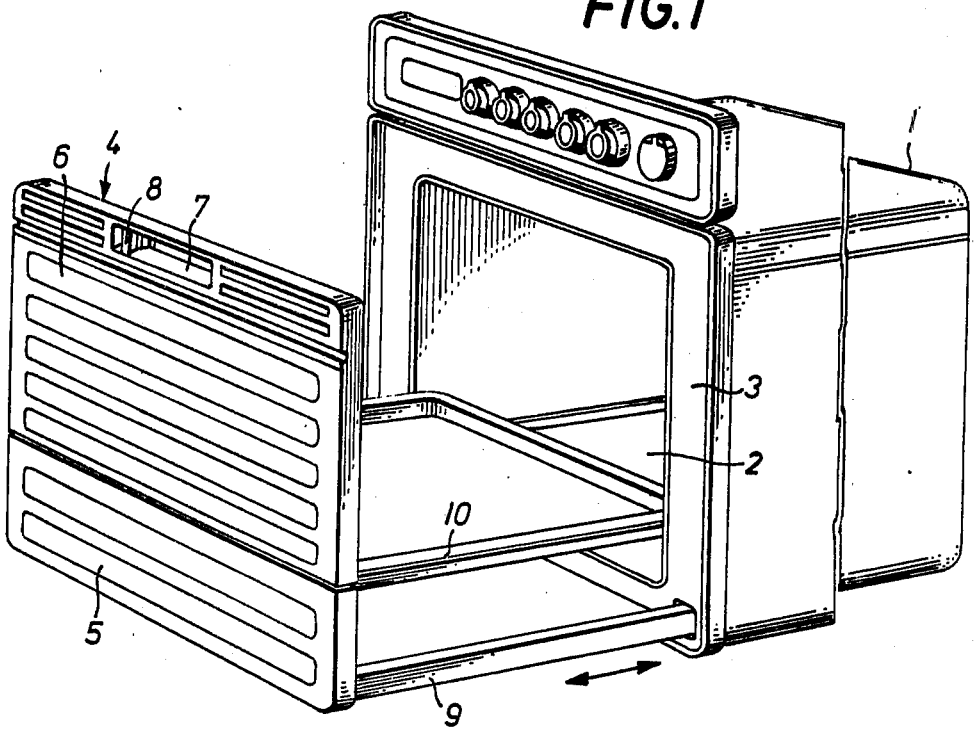
FIG. 1 is a perspective view of a preferred embodiment of the invention, showing the oven door in a pulled-out, vertical orientation.
Figure 3:
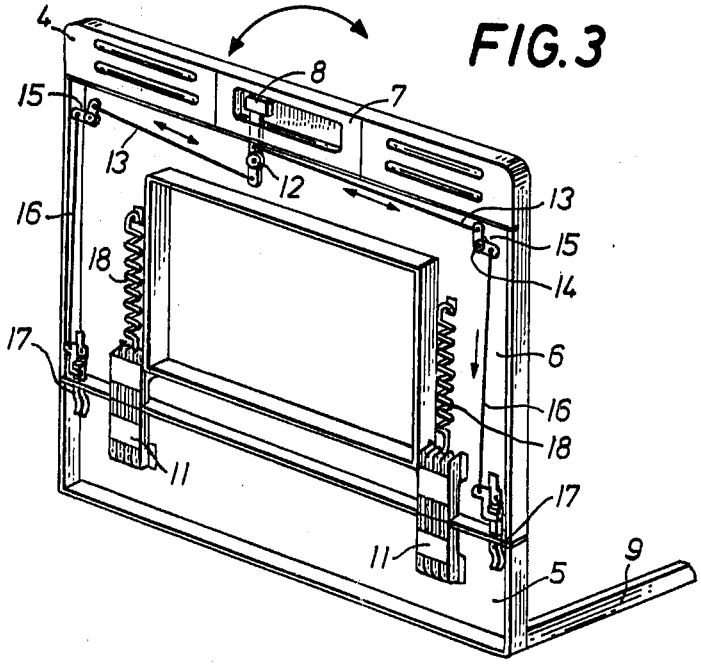
FIG. 3 is a perspective view of the oven door without its front wall.
Figure 2:
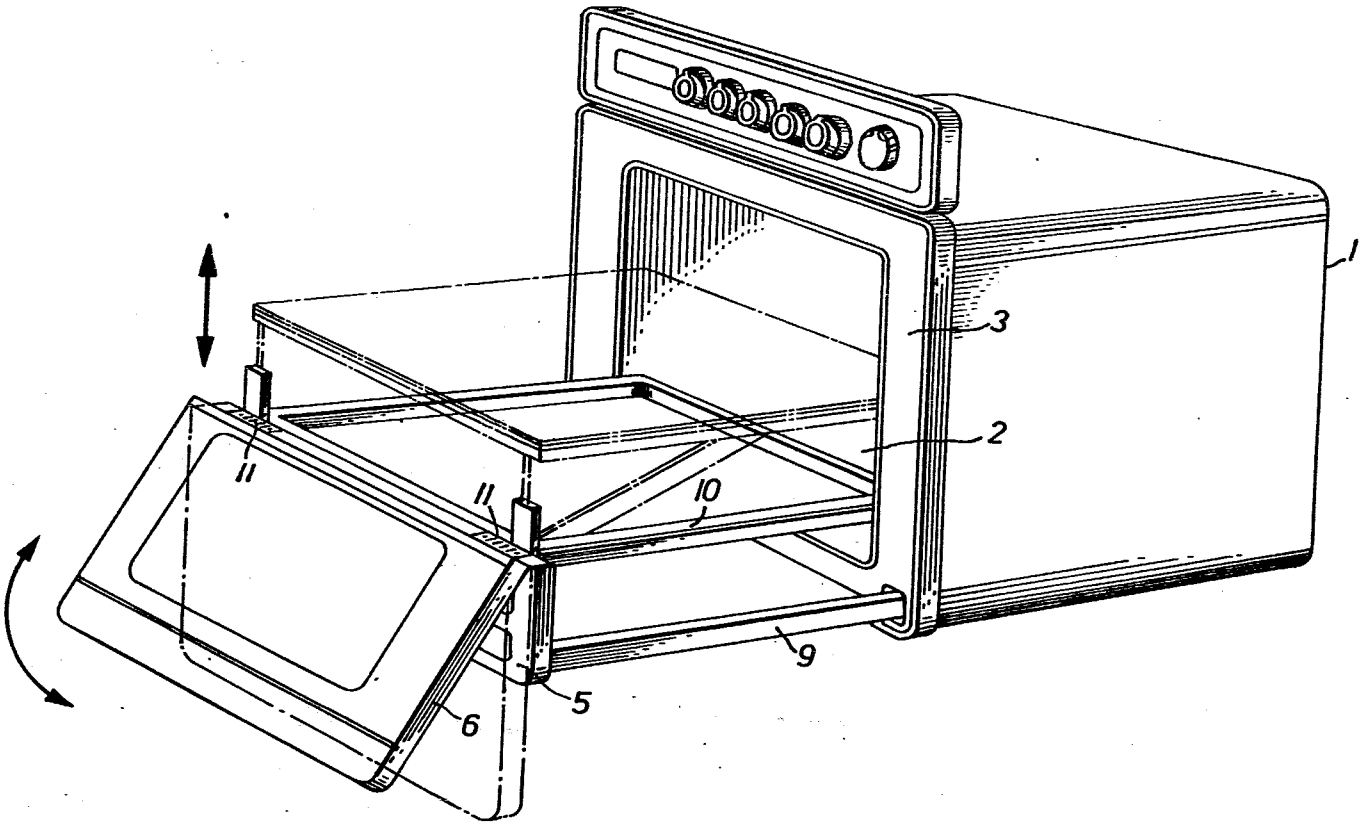
FIG. 2 is a perspective view of the same embodiment showing the oven door in a pulled-out, downwardly pivoted position.

Turning now to the figures, there is shown a baking oven 1 which comprises a flame tube 3 defining the baking chamber 2 and an oven door generally indicated at 4. The door 4 can be shifted in the horizontal direction for opening or closing the charging opening of the flame tube 3. The door 4 is horizontally divided into a lower rigid door portion 5 and an upper door portion 6 which is hinged to the top edge of the lower door portion 5 for pivotal movement forwardly and downwardly in a vertical plane about an axis extending along the horizontal division. The upper, pivotal door part 6 has about twice the height of the lower, rigid door portion 5. The hinge arrangement 11 between the door portions 5 and 6 permits a pivotal movement of 180° of the upper door portion 6 in an arcuate, vertically-oriented direction. In the upright position (FIG. 1), the upper door portion 6 is locked and thus cannot execute its forward vertical motion. To release the lock, an actuator element 8, forming part of a release arrangement and arranged in a recessed door handle 7, is depressed or rotated. Upon operating the actuator element 8, the lock immobilizing the upper door portion 6 in its vertical, upright orientation, orientation (in which it constitutes a vertically upward continuation of the lower door portion 5), is released and, as a result, the upper door portion 6 can be pivoted forwardly and downwardly through 180° into a face-to-face relationship with the outer vertical face of the lower door portion 5. The actuator element 8 is pivoted to a pin 12 on the door-inside. Horizontal tie rods 13 are hinged above and below the pin 12. Each one of the tie rods 13 is hinged in an angle bracket 15 that has a turning point 14. In each of the angle brackets 15 is hinged a vertical tie rod 16. The vertical tie rod 16 is hinged to the upper end of a snapping mechanism 17. The upper end of the snapping mechanism 17 is working together with the below end of the snapping mechanism 17 which end is attached to the lower door portion 5. A tension spring 18 is hinged to the actuator element 8. The spring 18 is fall-breaking whilst opening the upper door portion 6 by the actuator element 8.

Supporting and guiding rails 9 are fixedly attached to the lower door portion 5; the rails 9 are guided in the oven externally of the baking chamber 2 of the flame tube 3 and are pushed into and withdrawn from the oven housing as a unit with the door 5, 6, as the latter is pushed into its closed position or pulled into its open position, respectively. To the lower door portion 5 there is further secured a horizontally extending carrier tray 10 on which the food product is supported and which may be height-adjustable in a conventional manner.

It will be understood that the above description of the present invention is susceptible to various modifications, changes and adaptations, and the same are intended to be comprehended within the meaning and range of equivalents of the appended claims.

What is claimed is:

1. In a baking oven having a flame tube defining a baking chamber and a charging opening oriented in a vertical plane; a door for opening and closing the charging opening; rail means secured to the door and extending into the oven externally of the flame tube for providing a sliding support for the door for sliding movement in a horizontal direction towards and away from the charging opening; the improvement wherein said door being horizontally divided into a lower door portion and an upper door portion; the improvement further comprising pivot means connecting said upper door portion to said lower door portion for providing for a 180° swinging motion of said upper door portion about an axis extending along the horizontal division between a first position in which it constitutes a vertically upward continuation of said lower door portion, and a second position in which it is in a face-to-face relationship with an outer vertical surface of said lower door portion.

2. A baking oven as defined in claim 1, wherein said pivot means comprises a hinge arrangement providing for said 180° swinging motion of said upper door portion.

3. A baking oven as defined in claim 1, further comprising locking means having a locked state for preventing pivotal movement of said upper door portion from said first position and an unlocked state permitting said pivotal movement, and release means connected to said locking means for placing said locking means from a locked state to an unlocked state.

4. A baking oven as defined in claim 3, wherein said release means is secured to said door and is manually actuatable.

5. A baking oven as defined in claim 4, wherein said upper door portion comprises a recess serving as a door handle; the manually actuatable release means has a manually engageable operating element disposed in said recess.

* * * * *